US012539995B2

(12) United States Patent
Tan et al.

(10) Patent No.: US 12,539,995 B2
(45) Date of Patent: Feb. 3, 2026

(54) SYSTEM AND METHOD FOR AUTOMATED HANDLING OF ELASTICALLY COMPRESSIBLE ARTICLES

(71) Applicant: AFA TECHNOLOGIES SDN. BHD., Melaka (MY)

(72) Inventors: Ching Khang Tan, Melaka (MY); Ching Fooh Tan, Melaka (MY)

(73) Assignee: AFA TECHNOLOGIES SDN. BHD., Melaka (MY)

( * ) Notice: Subject to any disclaimer, the term of this patent is extended or adjusted under 35 U.S.C. 154(b) by 0 days.

(21) Appl. No.: 19/086,988

(22) Filed: Mar. 21, 2025

(65) Prior Publication Data

US 2025/0340319 A1 Nov. 6, 2025

(30) Foreign Application Priority Data

May 3, 2024 (MY) ..... PI2024002587

(51) Int. Cl.

| | |
|---|---|
| ***B65B 25/20*** | (2006.01) |
| ***B65B 5/06*** | (2006.01) |
| ***B65B 35/50*** | (2006.01) |
| ***B65B 57/20*** | (2006.01) |
| ***B65B 65/00*** | (2006.01) |
| ***B65B 65/08*** | (2006.01) |

(52) U.S. Cl.

CPC ..... *B65B 35/50* (2013.01); *B65B 5/068* (2013.01); *B65B 25/20* (2013.01); *B65B 57/20* (2013.01); *B65B 65/003* (2013.01); *B65B 65/08* (2013.01)

(58) Field of Classification Search

CPC ..... B65B 5/024; B65B 5/068; B65B 25/20; B65B 35/50; B65B 57/20; B65B 65/003; B65B 65/08

USPC ..... 53/447, 458, 500, 540, 564, 260

See application file for complete search history.

(56) References Cited

U.S. PATENT DOCUMENTS 3,329,252 A * 7/1967 Anderson ..... B65B 35/50 198/732
4,788,812 A * 12/1988 Morita et al. ..... B65B 35/50 53/247

(Continued)

FOREIGN PATENT DOCUMENTS

CN 106956816 A * 7/2017 ..... B65B 57/20
CN 108313378 A * 7/2018 ..... B65B 35/50

(Continued)

OTHER PUBLICATIONS

Notice of Grant issued in Malaysian Application No. PI2024002587, dated Oct. 29, 2024.

(Continued)

*Primary Examiner* — Stephen F. Gerrity
(74) *Attorney, Agent, or Firm* — HSML P.C.

(57) ABSTRACT

The embodiments of the present invention pertain to the broad technical domain of automation, with a specific focus on in-line processing of elastically compressible articles. More precisely, the present invention relates to a system and method for automated handling of elastically compressible article such as picking/stripping, stacking, counting, and packaging of the elastically compressible articles. More particularly, the present invention provides and in-line processing system and method, connecting these stages seamlessly to enhance overall article production efficiency.

22 Claims, 12 Drawing Sheets

(56) References Cited

U.S. PATENT DOCUMENTS

| | | | | | |
|---|---|---|---|---|---|
| 5,081,823 | A * | 1/1992 | van der Ent | ..... | B65B 35/50<br>53/542 |
| 10,239,646 | B2 | 3/2019 | Cao | | |
| 2023/0373135 | A1 | 11/2023 | Lee et al. | | |

FOREIGN PATENT DOCUMENTS

| | | | | | |
|---|---|---|---|---|---|
| CN | 110002034 | B * | 7/2024 | ..... | B65B 25/20 |
| EP | 0680882 | B1 | 6/1998 | | |
| KR | 101845684 | B1 * | 4/2018 | ..... | B65B 35/50 |
| WO | 2014122595 | A1 | 8/2014 | | |
| WO | WO-2019221594 | A1 * | 11/2019 | ..... | B65B 25/20 |

OTHER PUBLICATIONS

Substantive Examination Adverse Report issued in Malaysian Application No. PI2024002587, dated Sep. 6, 2024.
Substantive Examination Clear Report issued in Malaysian Application No. PI2024002587, dated Oct. 21, 2024.
Search Report issued in Malaysian Application No. PI2024002587, dated Sep. 6, 2024.

* cited by examiner

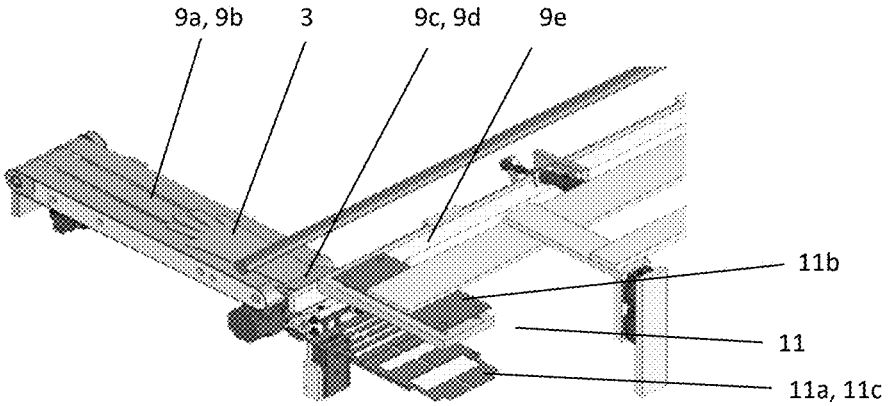
FIG. 6-A
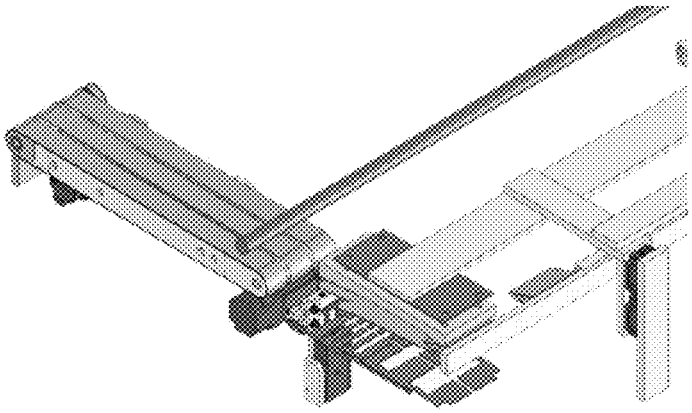
FIG. 6-B
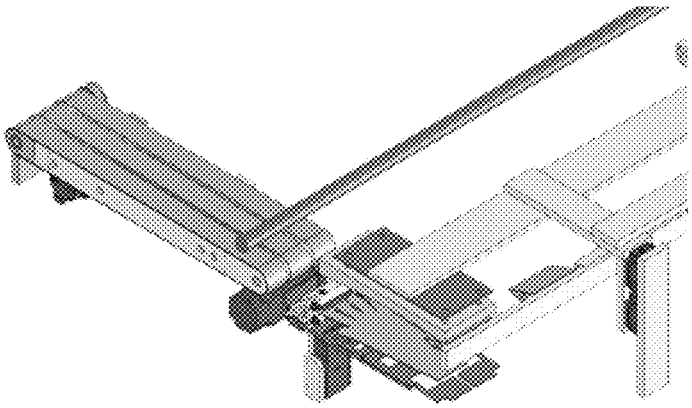
FIG. 6-C
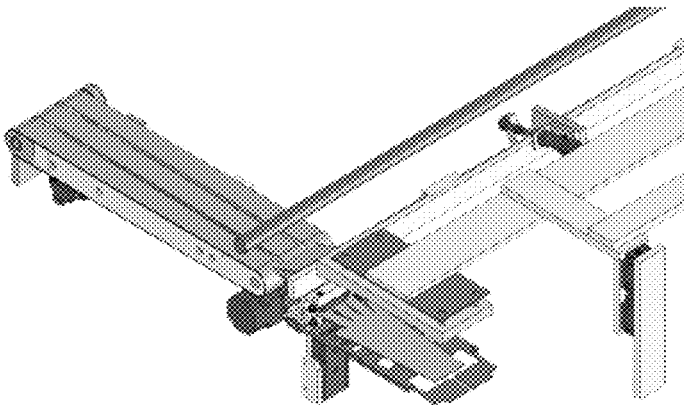
FIG. 6-D

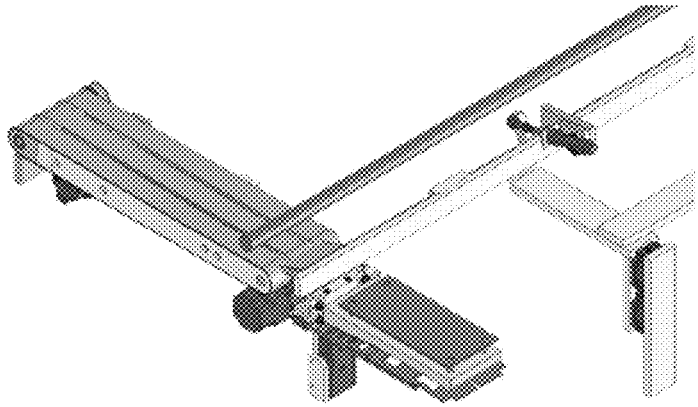
FIG. 6-E
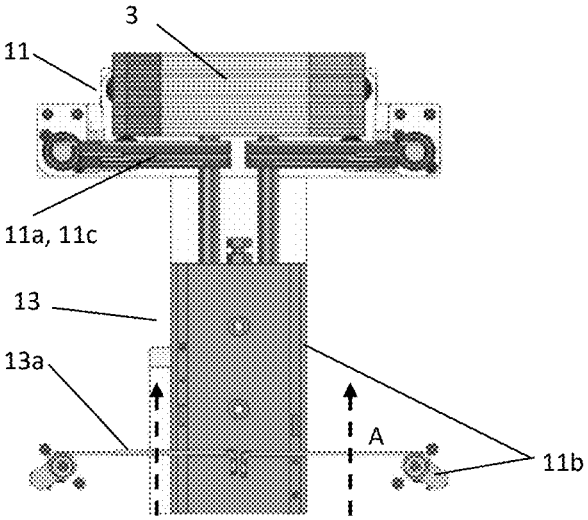
FIG. 7-A
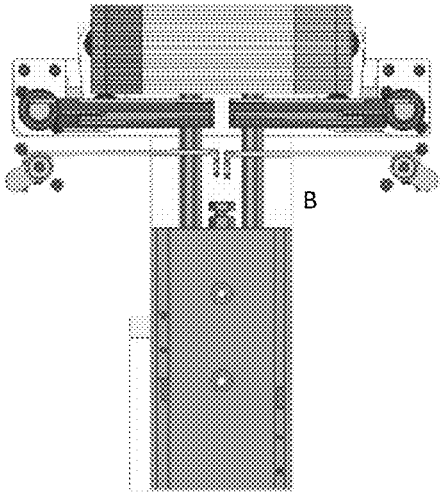
FIG. 7-B
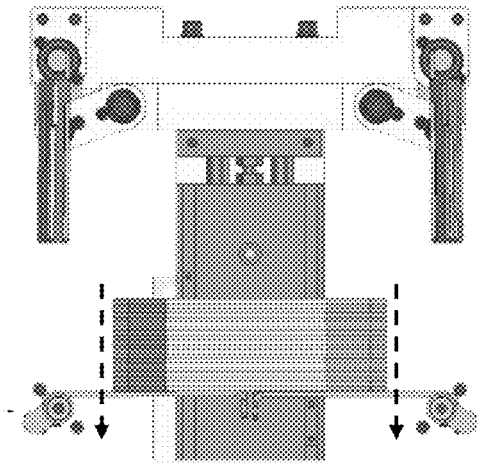
FIG. 7-D
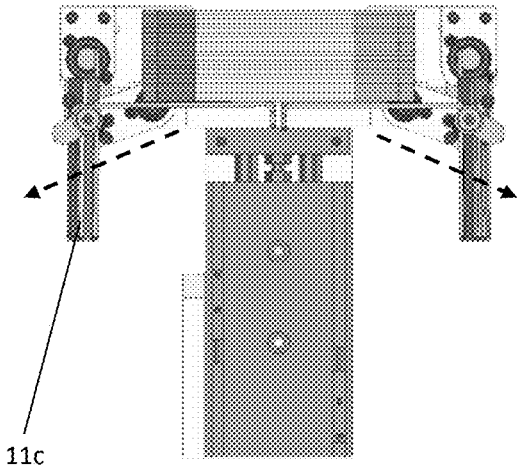
FIG. 7-C

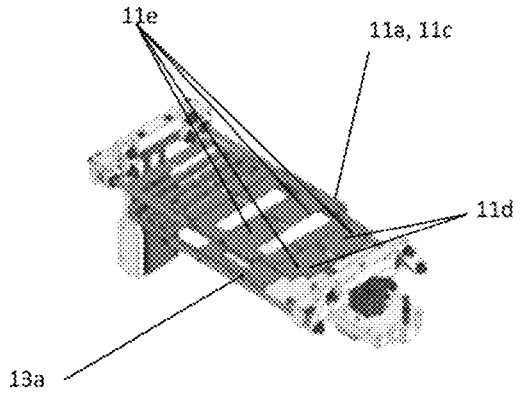
FIG. 8-A
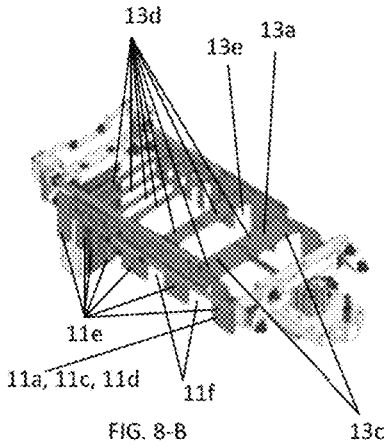
FIG. 8-B
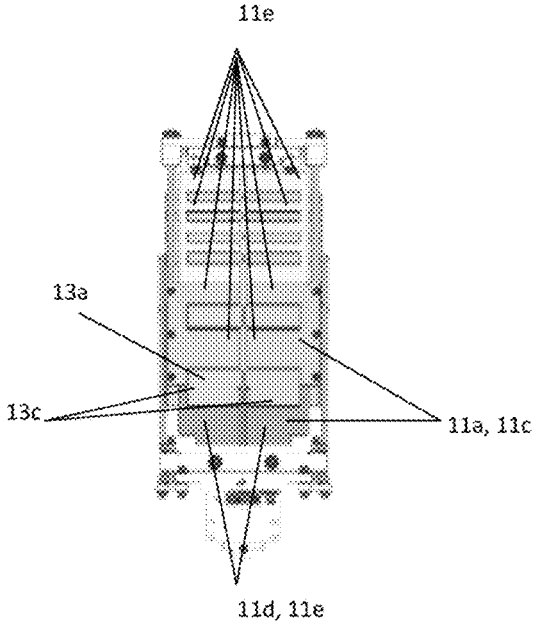
FIG. 9-A
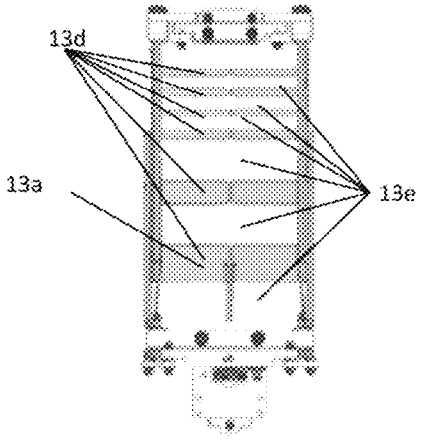
FIG. 9-B

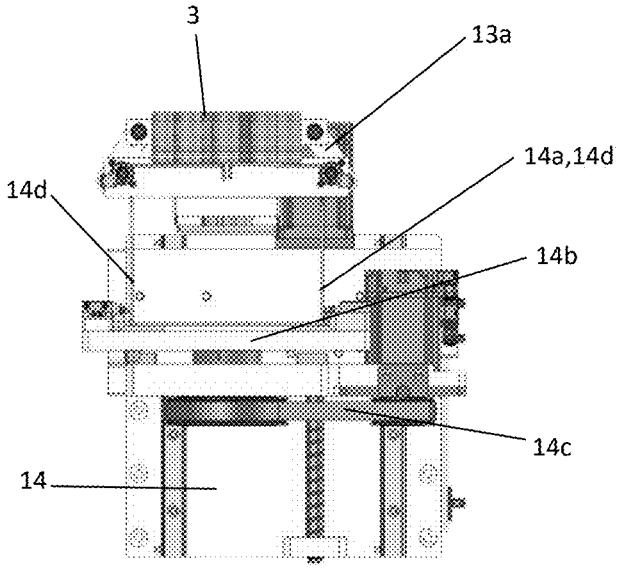
FIG. 10-A
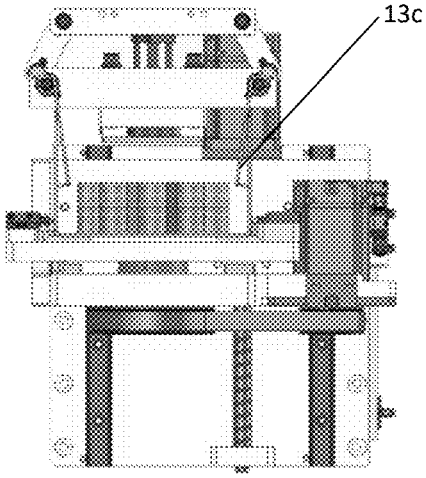
FIG. 10-B
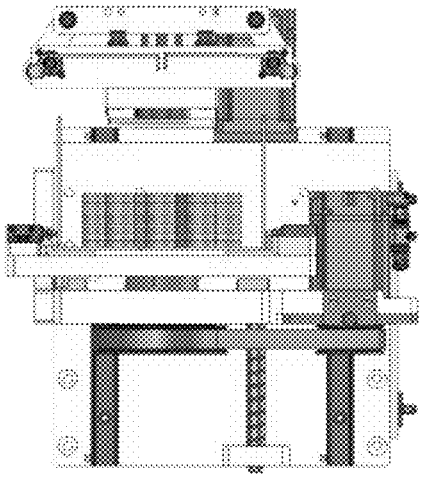
FIG. 10-D
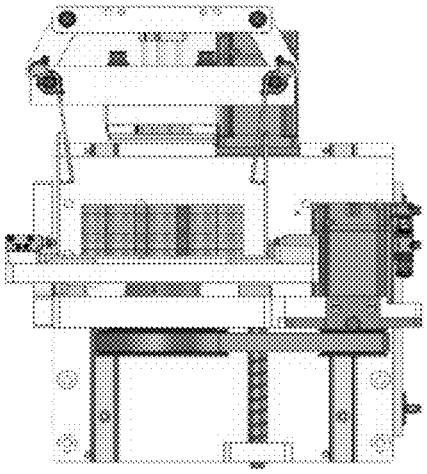
FIG. 10-C

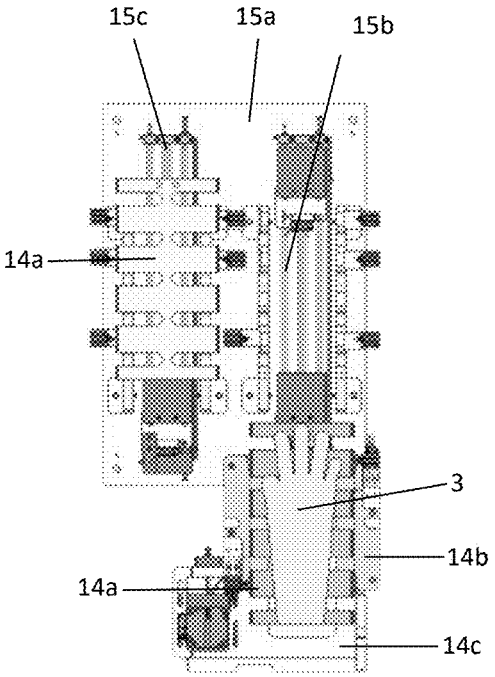
FIG. 11-A
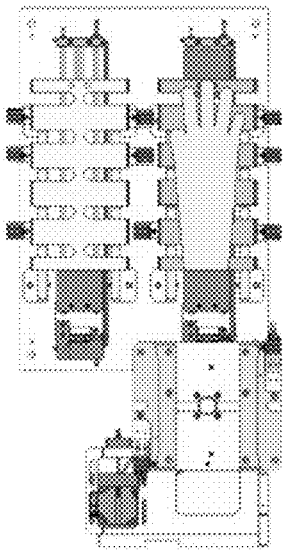
FIG. 11-B
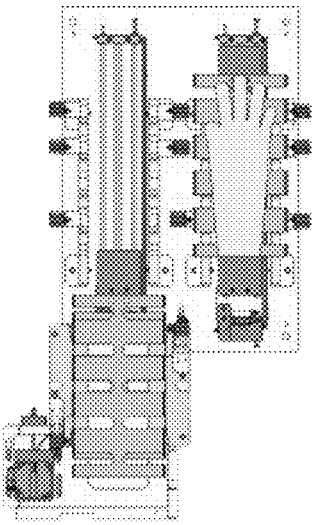
FIG. 11-C
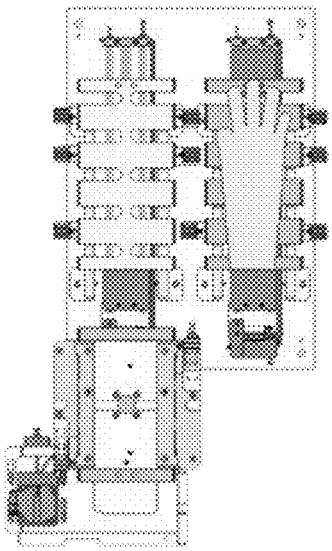
FIG. 11-D

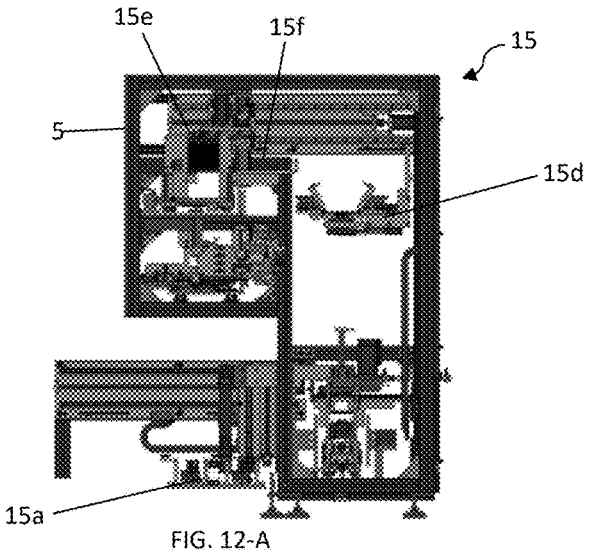
FIG. 12-A
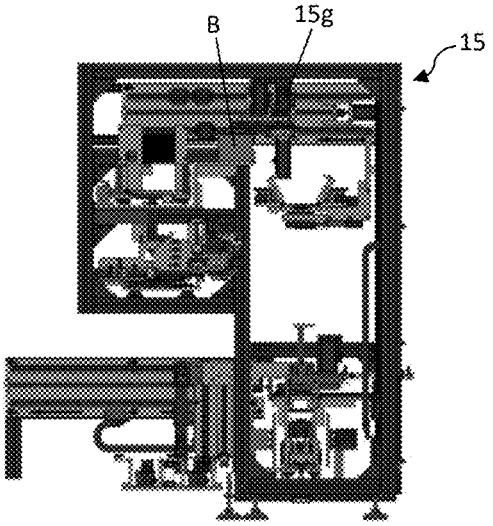
FIG. 12-B
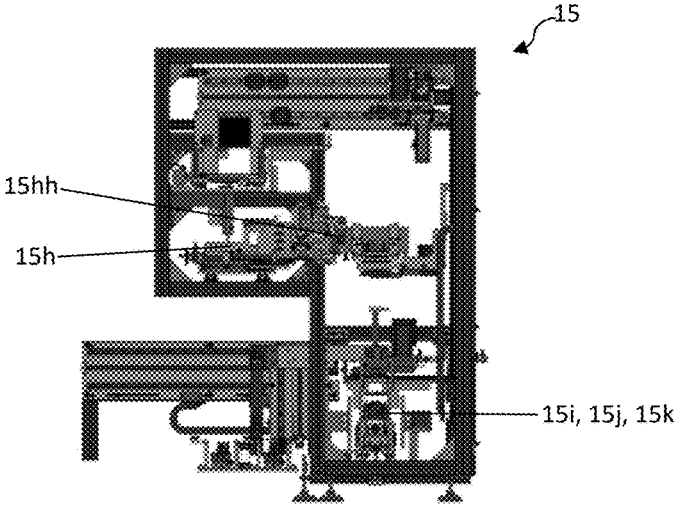
FIG. 12-D
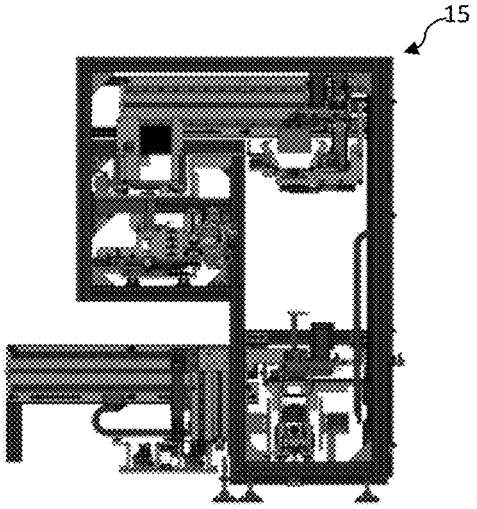
FIG. 12-C
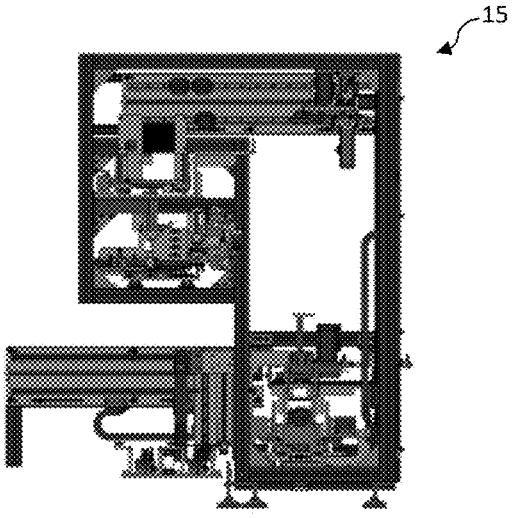
FIG. 12-E
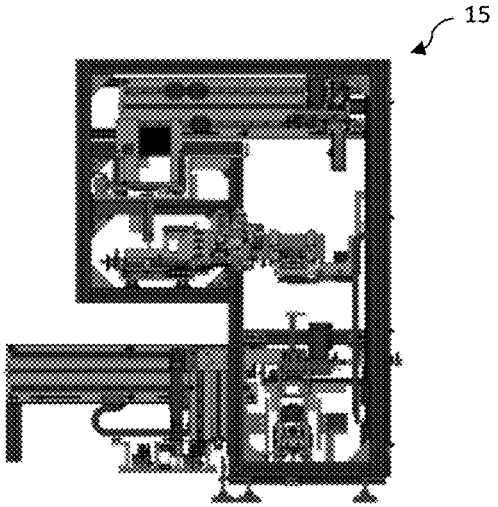
FIG. 12-F

SYSTEM AND METHOD FOR AUTOMATED HANDLING OF ELASTICALLY COMPRESSIBLE ARTICLES

TECHNICAL FIELD OF THE INVENTION

The embodiments of the present invention pertain to the broad technical domain of automation, with a specific focus on in-line processing of elastically compressible articles. More precisely, the present invention relates to a system and method for automated handling of elastically compressible articles such as pulling/stripping, stacking, counting, and packaging of the elastically compressible articles.

BACKGROUND OF THE INVENTION

The production of gloves has seen a significant increase in volume due to the growing demand, especially in industries such as healthcare, manufacturing, and food processing. This high-volume production requires efficient and automated processes to meet the demand and maintain cost-effectiveness. Traditional methods of manual handling and packaging become impractical and time-consuming when dealing with large quantities.

In the past, automation in glove production primarily focused on stacking and counting machines, which helped streamline some aspects of the process. However, the absence of an automated packaging system meant that after counting, gloves had to be manually transferred to packaging stations, where the gloves had to be packed manually by labours. Manual packaging resulted in increased labour costs, slower production rates, and the potential for errors or contamination.

In recent years, attempts were made to address these drawbacks with automatic packaging systems for gloves, but they remained separate entities from the stacking and counting machines. These separate systems resulted in a disjointed workflow, where gloves had to be transported between machines, causing delays and inefficiencies. The lack of integration increased the risk of contamination during the transfer process.

Additionally, the separate systems occupied more working space, making it challenging to optimize the layout of the production facility. Moreover, the transfer of gloves between machines introduced delays in the production timeline, affecting overall efficiency. Also, transferring gloves from one system to another increased the chances of contamination, compromising the quality of the final product.

Recognizing these challenges, the present invention introduces an innovative in-line processing system. This approach seamlessly integrates crucial glove production stages encompassing picking/stripping, stacking, counting, and packaging, thereby eliminating the necessity for manual transfers and providing a consolidated, space-efficient solution. The in-line system not only enhances production efficiency but also addresses contamination risks, thereby improving the overall operational efficiency in glove manufacturing.

SUMMARY OF THE INVENTION

The present invention introduces a system and method for the automated handling of elastically compressible articles, specifically focusing on gloves. This comprehensive solution integrates various mechanisms, including stripping means, conveying means, elevating means, picking means, glove carriers, erecting means, and tucking means, into a unified system. The method involves precise steps of stripping, conveying, counting, stacking, pressing, and packaging gloves seamlessly. A notable feature is the elimination of separate entities and waiting times, resulting in a continuous, efficient, and secure process without the need for manual transfers.

It is the primary objective of the present invention to enhance operational efficiency in the production of elastically compressible articles, specifically gloves. By integrating various stages into one unified system, the invention significantly streamlines the entire process, ensuring a seamless flow from the initial stripping to the final packaging.

It is yet another objective of the present invention to optimize workspace utilization. The elimination of separate systems and the integration of diverse functionalities result in a more compact and efficient production layout. This not only saves valuable space but also contributes to a more organized and streamlined workspace.

Furthermore, the present invention aims to reduce labor costs associated with manual transfers and packaging. Through automation, the need for extensive manual labor is minimized, leading to increased cost-effectiveness and resource optimization for glove manufacturers.

Additionally, the invention focuses on minimizing contamination risks during the production process. The integration of an in-line processing system eliminates the need for manual transfers between machines, reducing the chances of contamination and ensuring the production of high-quality gloves.

In essence, the present invention aims to revolutionize the automated handling of elastically compressible articles, offering a comprehensive solution that not only addresses the challenges associated with traditional methods but also brings forth a range of advantages, from increased efficiency to cost-effectiveness and improved product quality.

Preferably, in one embodiment, the invention introduces a unique automated stripping mechanism utilizing semi-rollers. These semi-rollers engage and rotate internally, effectively stripping elastically compressible articles, such as gloves, from the production line. This mechanism ensures a precise and controlled stripping process.

Preferably, in one embodiment, the invention involves a conveying station equipped with dual conveyors-a first conveying means, typically a conveyor belt, and a second conveying means. The first conveyor receives articles from the stripping station, while the second conveying means facilitates the smooth transfer of articles to the counting and stacking station, employing advanced mechanisms like picking means for efficient conveyance.

Preferably, in one embodiment, the invention encompasses a counting and stacking unit, featuring temporary glove storage bins aligned with the second conveying means. Each bin has a pressing means positioned above it, ensuring that articles, once conveyed into the bin, are efficiently pressed to release air. This results in neatly stacked and compact articles within the bin.

Preferably, in one embodiment, the invention introduces an intermediate elevatable tray as a distinctive feature. In an embodiment, this tray engages with the temporary glove storage bin, facilitating the efficient transfer of stacked gloves. A tertiary transferring unit, comprising moveable trays, ensures a continuous and synchronized rotation, optimizing the flow of gloves from the counting and stacking unit to the packaging station.

Preferably, in one embodiment, the invention incorporates a packaging unit having a loading station with movable glove carriers on a rail, ensuring a smooth transfer from the tertiary transferring unit without delays. It further includes a deck unit with packaging box loading and erecting stations, providing a systematic approach to glove packaging. The tucking station with 7-in-1 tucking combination completes the packaging process with precision.

A central embodiment of the invention is the integrated in-line processing system, connecting all crucial stages of glove production seamlessly. This embodiment eliminates the need for manual transfers between machines, offering a consolidated and space-efficient solution. The in-line system enhances overall operational efficiency while mitigating contamination risks.

In summary, the embodiments of the present invention collectively contribute to a sophisticated and comprehensive system for automated handling of elastically compressible articles, particularly gloves. Each embodiment addresses specific challenges in the production process, culminating in a system that is not only innovative but also highly efficient and practical for the glove manufacturing industry.

According to the preferred embodiment of the present invention, the following is provided, A system (1) for automated handling of at least one elastically compressible article (3), comprising:

at least an article conveying unit (9) for conveying said article;

at least an article counting and stacking unit (11) for counting and stacking the article received from the article conveying unit (9), wherein said article counting and stacking unit (11) is connected adjacent to the article conveying unit (9);

at least an article transferring unit (13) for transferring article received from the article counting and stacking unit (11), wherein said article transferring unit (13) is connected adjacent to the article counting and stacking unit (11); and at least an article packaging unit (15) for packaging the article received from the article transferring unit (13), wherein said article packaging unit (15) is connected adjacent to the article transferring unit;

characterized in that the article conveying unit (9), the article counting and stacking unit (11), the article transferring unit (13), and the article packaging unit (15) are accommodated as a unified system.

According to another preferred embodiment of the present invention, the following is provided, A system (1) for automated handling of at least one elastically compressible article (3), comprising:

at least an article stripping unit (7) for stripping off the article from production line:

at least an article conveying unit (9) for conveying said article from said article stripping unit (7), wherein said article conveying unit (9) is connected adjacent to the article stripping unit (7);

at least an article counting and stacking unit (11) for counting and stacking the article received from the article conveying unit (9), wherein said article counting and stacking unit (11) is connected adjacent to the article conveying unit (9);

at least an article transferring unit (13) for transferring article received from the article counting and stacking unit (11), wherein said article transferring unit (13) is connected adjacent to the article counting and stacking unit (11); and at least an article packaging unit (15) for packaging the article received from the article transferring unit (13), wherein said article packaging unit (15) is connected adjacent to the article transferring unit:

characterized in that the article stripping unit (7), the article conveying unit (9), the article counting and stacking unit (11), the article transferring unit (13), and the article packaging unit (15) are accommodated as a unified system.

In another preferred embodiment of the present invention, the following is provided, A method (100) for automated handling of at least one elastically compressible article (3) comprising the steps of:

i. conveying at least an elastically compressible article to a stripping unit;

ii. conveying the elastically compressible article from the stripping unit to a conveying unit;

iii. conveying the elastically compressible article from the conveying unit to a counting and stacking unit;

iv. counting and stacking the elastically compressible article;

v. conveying the elastically compressible article from the counting and stacking unit to an article transferring unit;

vi. conveying the elastically compressible article from the article transferring unit to an article packaging unit;

characterized in that said method further comprising the step of packaging the elastically compressible article after the step of conveying the elastically compressible article from the article transferring unit to an article packaging unit, wherein the method is carried out continuously in the sequence.

BRIEF DESCRIPTION OF THE DRAWINGS

Other aspect of the present invention and their advantages will be discerned after studying the Detailed Description in conjunction with the accompanying drawings in which:

FIGS. 6-A, 6-B, 6-C, and 6-D illustrate an exemplary glove transfer process from an article conveying unit to a counting and stacking unit according to the preferred embodiment of the present invention.

FIG. 6-E illustrates an exemplary view of a gloves pressing process within the counting and stacking unit according to the preferred embodiment of the present invention.

FIGS. 7-A, 7-B, 7-C, and 7-D illustrate an exemplary glove transfer process from the counting and stacking unit to an article transferring unit according to the preferred embodiment of the present invention.

FIGS. 8-A and 8-B illustrate exemplary perspective views of an engagement between the counting and stacking unit to the article transferring unit during glove transfer process according to the preferred embodiment of the present invention.

FIGS. 9-A and 9-B illustrate exemplary top views of an engagement between the counting and stacking unit to the article transferring unit during glove transfer process according to the preferred embodiment of the present invention.

FIGS. 10-A, 10-B, 10-C, and 10-D illustrate an exemplary glove transfer process within the article transferring unit according to the preferred embodiment of the present invention.

FIGS. 11-A, 11-B, 11-C, and 11-D illustrate an exemplary glove transfer process from the article transferring unit to an article packaging unit according to the preferred embodiment of the present invention.

FIGS. 12-A, 12-B, 12-C, 12-D, 12-E, and 12-F illustrate an exemplary glove packaging process within the article packaging unit according to the preferred embodiment of the present invention.

DETAILED DESCRIPTION OF THE DRAWINGS

Figure 1:
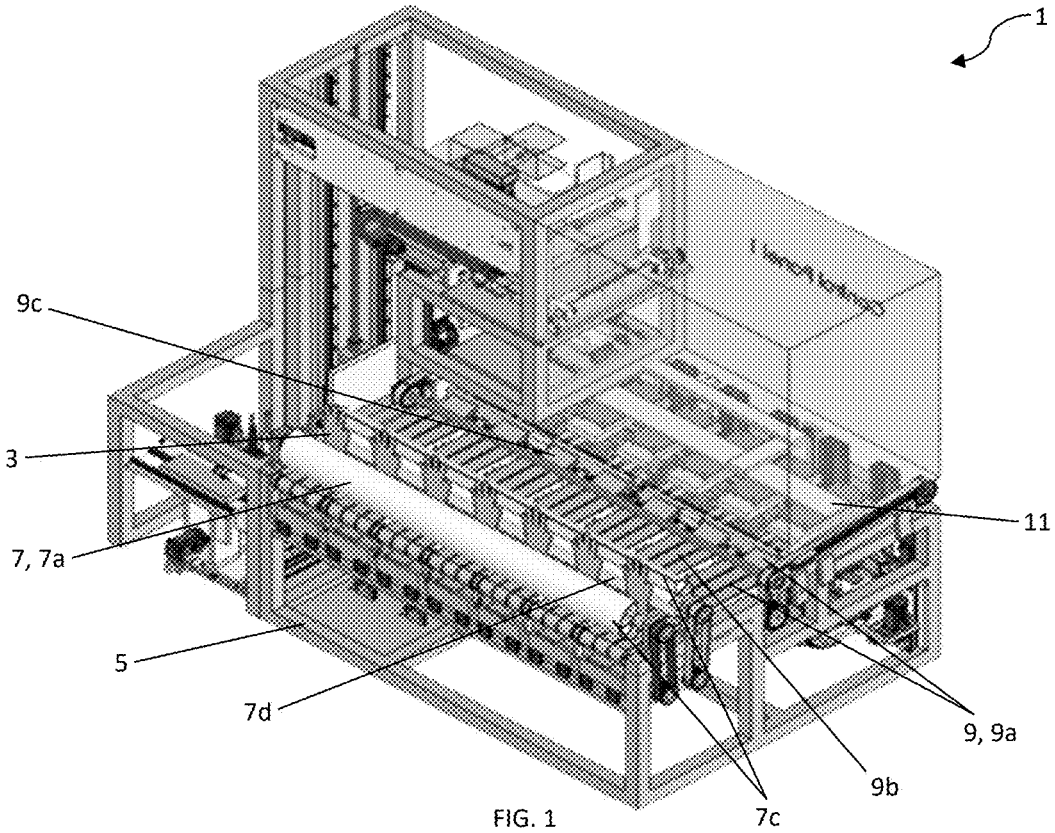
FIG. 1 illustrates an exemplary front perspective view of a system for automated handling of the elastically compressible articles according to the preferred embodiment of the present invention.
Figure 2:
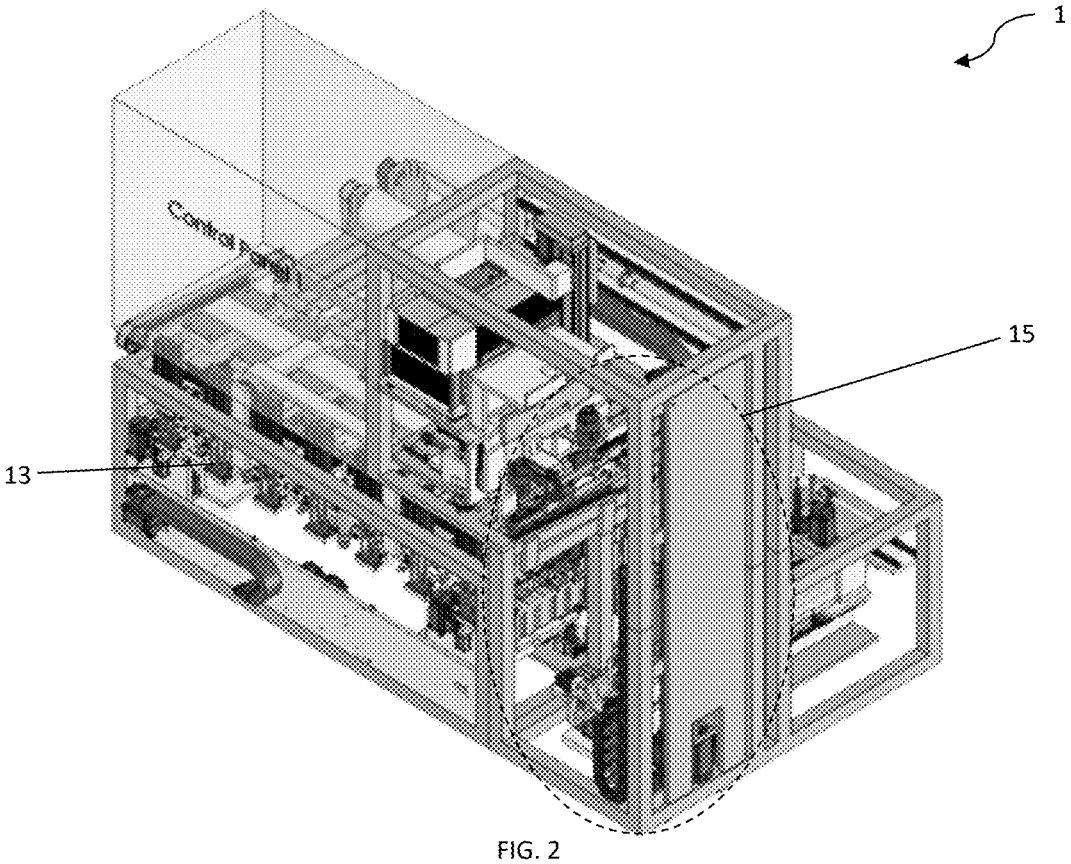
FIG. 2 illustrates an exemplary back perspective view of the system for automated handling of the elastically compressible articles according to the preferred embodiment of the present invention.
Figure 3:
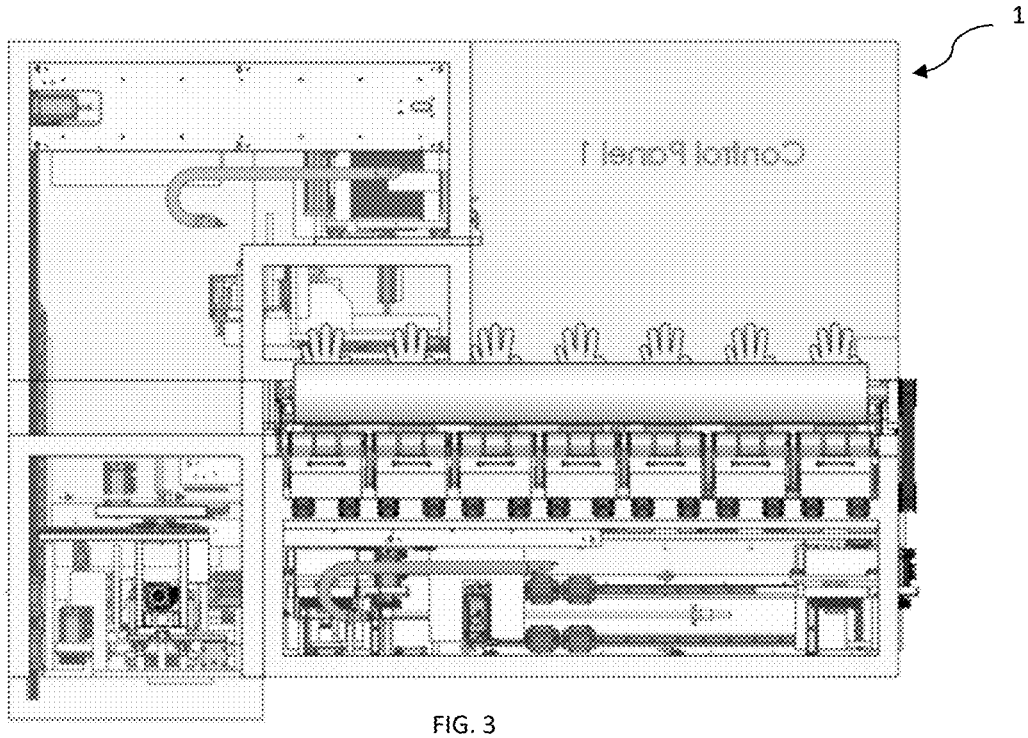
FIG. 3 illustrates an exemplary front view of the system for automated handling of the elastically compressible articles according to the preferred embodiment of the present invention.
Figure 4:
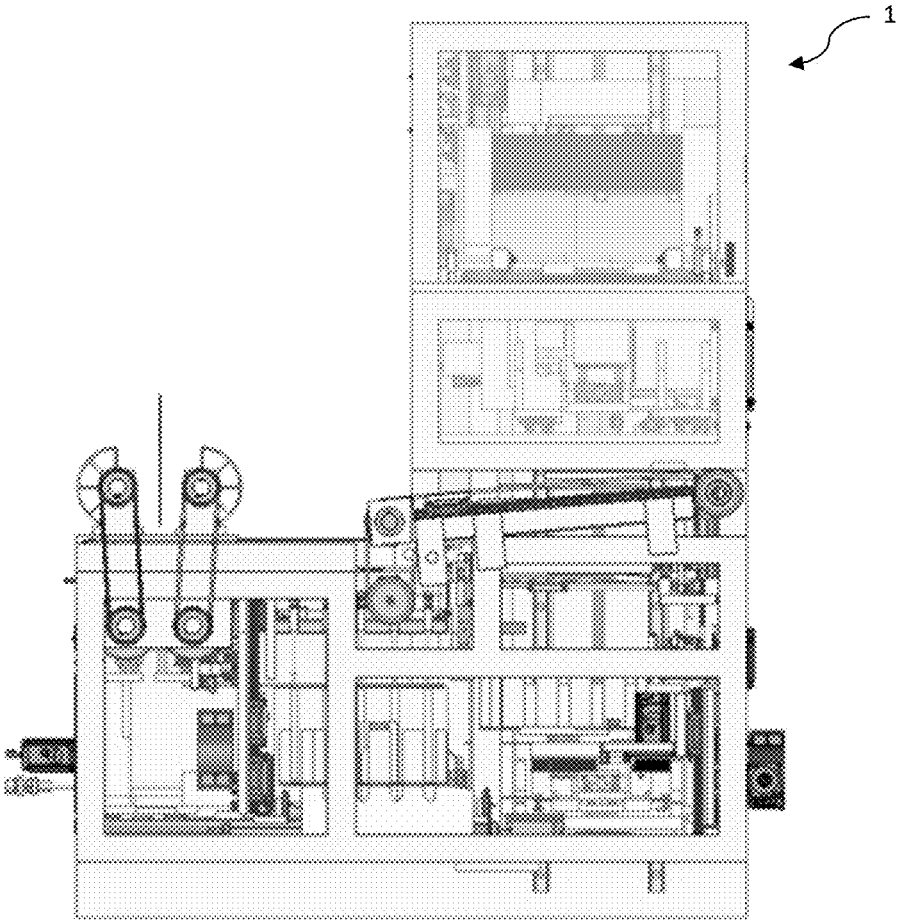
FIG. 4 illustrates an exemplary side view of the system for automated handling of the elastically compressible articles according to the preferred embodiment of the present invention.
Figure 5:
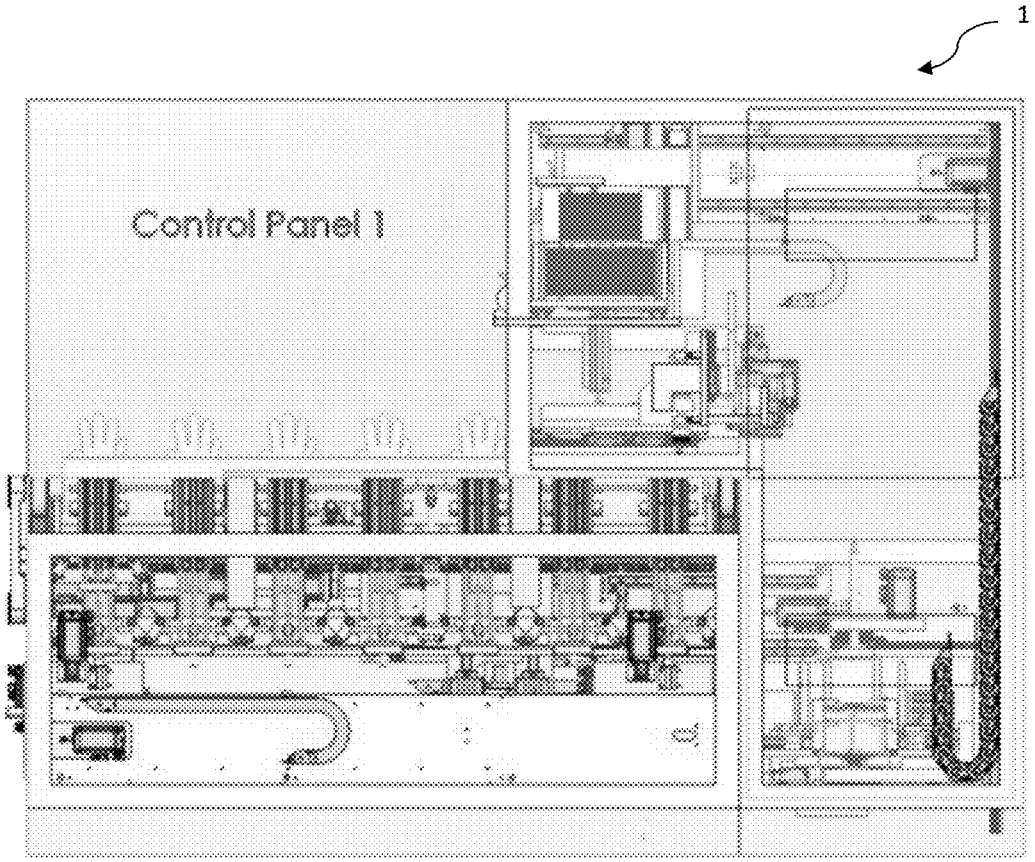
FIG. 5 illustrates an exemplary back view of the system for automated handling of the elastically compressible articles according to the preferred embodiment of the present invention.

In the following detailed description, numerous specific details are set forth in order to provide a thorough understanding of the invention. However, it will be understood by the person having ordinary skill in the art that the invention may be practised without these specific details. In other instances, well known methods, procedures and/or components have not been described in detail so as not to obscure the invention.

The invention will be more clearly understood from the following description of the embodiments thereof, given by way of example only with reference to the accompanying drawings, which are not drawn to scale.

As used in this disclosure and the appended claims herein, the singular forms "a", "an", and "the" include plural referents unless the context clearly dictates or denotes otherwise.

Throughout the disclosure and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment, "such as" is not used in a restrictive sense, but for explanatory purposes.

The embodiments of the present invention are centered around a system (1) and method (100) for automated handling of at least one elastically compressible article (3) including but not limited to pulling/stripping, stacking, counting and packaging process. The term "elastically compressible article," as used in this document, encompasses various glove types, including but not limited to vinyl gloves, nitrile gloves, latex gloves, medical gloves, safety gloves, and others.

In the depicted preferred embodiment, illustrated in FIGS. 1, 2, 3, 4 and 5, the automated system (1) for pulling/stripping, stacking, counting and packaging of at least one elastically compressible article comprising several interconnected units, stations or apparatuses functioning as a unified system (1). Unified system means the convergence and integration of multiple units, stations or systems to enable dynamically interaction so as to produce a continuously productivity, to increase efficiency or to produce centralized management. The automated system (1) comprising at least an article stripping unit (7), at least an article conveying unit (9), at least an article counting and stacking unit (11), at least an article transferring unit (13); at least a article packaging unit (15), and at least a system control unit (not shown) responsible for overseeing, regulating, signalling, instruction or operating the functions of the entire system. The units (7, 9, 11, 13, 15) are preferably interconnected within the system structure (5). Additionally, they can be interconnected to each other as a unified system via different system structures (5). In one embodiment, the automated system (1) only at least an article conveying unit (9), at least an article counting and stacking unit (11), at least an article transferring unit (13): at least an article packaging unit (15), and at least a system control unit (not shown). In this configuration, the stripping unit (7) may be offered as a separate standalone system.

In accordance with the embodiments of the present invention, the transfer of elastically compressible articles between units (7, 9, 11, 13, 15) may employ various transfer methods or any suitable transfer methods. These transfer methods include, but are not limited to, pick & place systems, robotic arms, conveyors, suction and discharge mechanisms, pulling and discharge systems, and more. Additional alternatives for transferring methods could include pneumatic grippers, magnetic conveyors, vacuum suction arms, shuttle systems, and sliding transfer trays.

Although the present invention is intended for a unified system, it is nevertheless envisaged that the present invention may be separated into multiple systems depending on user's requirements and applications.

The article stripping unit (7) of the system (1) comprising at least a stripping/pulling means (7*a*) connected to the system structure (5), and at least a power transmission unit (7*b*) such as gears, motor, belt or chain connected to said stripping/pulling means (7*a*) for motorizing said stripping/pulling means (7*a*). Preferably, the stripping/pulling means (7*a*) is a pair of semi-rollers (7*c*) where it is intended to be spaced apart to form a glove channel (7*d*) and engaged with the dipping line of the glove production process. As gloves (3) semi-demold from the hand mold apparatus during the final stages of glove production stream line, they pass through the channel (7*d*) between the semi-rollers (7*c*) of the article stripping unit (7). When a preset number of gloves (3) is reached or detected, the semi-rollers (7*c*) engage with each other wherein the surfaces of the semi-rollers (7*c*) adhered to each other, sandwiching the gloves (3) and rotate internally by the power transmission unit (7*b*) and effectively pulling the gloves (3) off from the mold apparatus. Preferably, detecting sensors (not shown) are employed to detect the quantity of gloves (3) passing through the semi-rollers (7*c*) in order for the system control unit to instruct the semi-rollers (7*c*) to operate. After the gloves (3) are stripped off, the semi-rollers (7*c*) disengage with each other and form back the gloves channel (7*d*), allowing the gloves (3) to be released, and stationed for next stripping cycles.

Connected beneath the article stripping unit (7), the article conveying unit (9) of the system (1) comprises at least a first conveying means (9*a*), typically a conveyor belt of a group of conveyor belts (9*b*). This arrangement is strategic to enable the simultaneous reception of gloves (3) stripped off from the dipping line. The conveyor belts (9*b*) operate in parallel, enhancing the system's capability to efficiently handle multiple gloves (3) concurrently. After being stripped off from the dipping line by the stripping means (7*a*), the gloves (3) are laid out on these conveyor belts (9*b*). Subsequently, this conveyor belt system (9*b*) relying on the signal of the system control unit transports the gloves (3) to the subsequent station, particularly the counting and stacking unit (11) of the system (1). Alternatively, the first conveying means (9*a*) may operate continuously without waiting the signal of the system control unit.

Additionally, the article conveying unit (9) of the system (1) further comprising at least a second conveying means (9*c*) connected after the first conveying means (9*a*) for conveying the gloves (3) from the conveyor belt (9*b*) of the first conveying means (9*a*) to the counting and stacking unit (11) of the system (1). The second conveying means (9*c*) in the article conveying unit (9) is preferably in the form of a clipping device, although it is conceivable that picking, pulling, adsorbing, or similar means could also be employed. The operational mechanism of the second conveying means (9*c*) is further illustrated in FIGS. 6-A, 6-B, 6-C, and 6-D.

In this embodiment, said conveying means is a pair of clippers (9*d*) mounting on a first mounting apparatus (9*e*). As the glove (3) is transferred from the front to the end of the first conveying means (9*a*), the clipper (9*d*), under the control of the system control unit, opens to secure the wrist portion of the gloves (3). Subsequently, the mounting apparatus (9*e*) moves backward to a position above the counting and stacking unit (11), simultaneously transporting the clipped glove (3) with the clipper (9*d*) mounted on it. Following this, the clipper (9*d*) opens to release the glove (3) onto the counting and stacking unit (11). The clipper (9*d*) and the first mounting apparatus (9*e*) then return to the initial position for subsequent cycles.

Moving on to the counting and stacking unit (11) of the system (1), it is connected to the article conveying unit (9), comprises a temporary glove storage bin (11*a*) or a group of such bins (11*a*). These bins (11*a*) are aligned with the second conveying means (9*c*) and the first conveying means (9*a*) to facilitate an organized flow of gloves (3). As gloves (3) are laid on the conveyor belt (9*b*) following the stripping process, they move systematically and travel in a line towards their designated temporary glove storage bin (11*a*).

Within the counting and stacking unit (11), a pivotal feature is the incorporation of pressing means (11*b*) positioned strategically above each bin, configured to press the gloves (3) when conveyed into the bin (11*a*) to release excess air from the gloves (3) as further illustrated in FIG. 6-E, thereby ensuring that the stacked gloves (3) within the bin (11*a*) do not occupy unnecessary space, maintaining a compact arrangement. To maintain a systematic count of the gloves in the bin, a counter (not shown) is provided to cooperate with the pressing means (11*b*), keeps track and records the number or quantity of gloves (3) in the bin (11*a*). The counter may count when the pressing means (11*b*) press or when gloves (3) are transmitted into the bin (11*a*). As the stripping and conveying processes repeat, the gloves (3) accumulate systematically within the bin (11*a*), with each glove (3) undergoing gentle compression by the pressing means (11*b*). This dual functionality ensures not only an organized stacking process but also an accurate record of the total quantity of gloves (3) within the bin (11*a*). The counter's independent cooperation with the pressing means (11*b*) offers flexibility in the counting mechanism, further contributing to the precision and efficiency of the overall system (1).

The temporary glove storage bin (3) has an open top and is enclosed with a bin gate (11*c*) at the bottom, of which is capable of automatically opening and closing. The bin gate (11*c*), under the control of the system control unit, releases gloves (3) from the bin when a predetermined number is reached. Each bin gate (11*c*) may function independently or collectively based on the system control unit. The number of the temporary glove storage bin (11*a*) and the pressing means (11*b*) shall be set to be the same as that if the number of the first and second conveying means (9*a*, 9*c*). The number of temporary glove storage bin (11*a*), the pressing means (11*b*), the first and second conveying means (9*a*, 9*c*) shall be correspondingly increased so that the whole system (1) is capable to adapt to faster production speed.

The article transferring unit (13), a distinctive feature of the system (1), aims to efficiently transfer gloves (3) from the counting and stacking unit (11) to the packaging unit (15) within the same system (1), eliminating the need for separate systems. Referring now to FIG. 7-A, this article transferring unit (13) comprises at least a drop-prevention mechanism or anti-gravitational means for transferring articles (3). Said drop-prevention mechanism or anti-gravitational means is configured to facilitate the transfer of said articles (3) between the counting and stacking unit (11) to the packaging unit (15), wherein said drop-prevention mechanism or anti-gravitational means substantially reduces or eliminates any drop effect during the transfer process. The drop-prevention mechanism or anti-gravitational means can encompass various mechanisms or methods, including any technology that effectively mitigates or minimizes the drop effect during transfer, regardless of the specific implementation.

In a specific embodiment, the drop-prevention mechanism or anti-gravitational means comprises an intermediate elevatable tray (13*a*), potentially a group of such trays (13*a*), arranged below or connected beneath the counting and stacking unit (11), particularly the temporary glove storage bin (11*a*). The tray (13*a*), controlled by at least an elevating means (13*b*) under the system control unit, is configured to elevate from its initial position, as demarcated by letter "A" to a position below the temporary glove storage bin (3), as demarcated by letter "B" when the bin (11*a*) is full of stacked gloves (3) or reached its capacity. FIG. 7-A, FIG. 7-B, 7-C, and 7-D illustrate the working mechanism of such intermediate elevatable tray (13*a*). Preferably, the tray (13*a*) ascends upward to establish a connection with the bin (3) and engage with the bin (3). When the bin gate (11*c*) is opened, the gloves (13) are neatly rested or held in the tray (13*a*), avoiding any faulty or missed drops. Once the gloves (13) are contained in the tray (13*a*), it elevates back to its initial position for subsequent transfer. This deliberate design eliminates potential issues that conventional systems face, where gloves (3) are dropped from a full height, often resulting in missed drops due to various reasons. Such missed drops or a stack of gloves (3) may disrupt the system, causing jams or crashes. Hence, this intermediate elevatable tray (13*a*) deliberately preventing gloves (3) from falling directly into the tray (13*a*) from a full height, a common practice in conventional systems. This precautionary measure is vital in averting missed drops and potential disruptions in system functionality.

FIGS. 8-A, 8-B, 9-A, and 9-B provide further clarification on the interaction between the bin (11*a*) and the elevatable tray (13*a*) in both perspective view and top view respectively, specifically highlighting at least an anti-obstruction engaging means that ensures the unimpeded opening and closing of the bin (3) when the elevatable tray (13*a*) is in engagement. This anti-obstruction engaging means is preferably characterized by the bin gate (11*c*), which comprises either a single gate leaf (11*d*) or a pair of gate leaves (11*d*). Each gate leaf (11*d*) is constructed with a series of first spaced-apart members (11*e*). This anti-obstruction engaging means is also characterized by the elevatable tray (13*a*), which comprises either a single tray leaf (13*c*) or a pair of tray leaves (13*c*), with each tray leaf (13*c*) constructed using a series of second spaced-apart members (13*d*). During engagement, each second spaced-apart member (13*d*) is elevated in a direction towards the spacing (11*f*) between each first spaced-apart member (11*e*). This arrangement ensures that the opening of the first spaced-apart members (11*e*) remains unobstructed. As the first spaced-apart members (11*e*) open, they swing within the spacing (13*e*) between the second spaced-apart members (13*d*), facilitating smooth and unobstructed movement.

The intermediate elevatable tray's leaf (13*c*) is also capable of opening and closing, to release gloves to a subsequent station or unit, known as a tertiary transferring unit (14), of which is a part of the article transferring unit (13). Referring to FIG. 10-A, 10-B, 10-C and 10-D, which show the gloves transferring process from the intermediate elevatable tray (13*a*) to the tertiary transferring unit (14).

The tertiary transferring unit (14), connected beneath the intermediate tray (13*a*), comprises at least a moveable tray (14*a*). Said moveable tray (14*a*), in one embodiment, is slidably mounted on a tray turntable (14*b*) capable of rotation to adjust the positioning of the gloves (3). This tray turntable (14*b*) slides and/or rotates within a railing unit (14*c*) beneath the intermediate elevatable tray (13*a*), ensuring a carefully designed dropping height to prevent gloves missed drops. The railing unit (14*c*) is preferably capable of switching its position between a first and second position, facilitated by a moving mechanism.

Preferably, said moveable tray (14*a*) comprising heightened sides (14*d*), in a box-like configuration with an open top. When the intermediate elevatable tray (13*a*) is configured to release the stacked gloves (3) from the tray's leaf (13*c*), the tray's leaf (13*c*) swings down and engaged with the inner sides of the moveable tray (14*a*), allowing the stacked gloves (3) to release onto the moveable tray (14*a*) in a closed manner, preventing the gloves (3) from missed drop. After the moveable tray (14*a*) of the tertiary transferring unit (14) is filled with stacked gloves (3) from the intermediate tray (13*a*), the intermediate tray's leaf (13*c*) closes and the moveable tray (14*a*) slides to a subsequent station, which will be elaborated on in detail in the following paragraphs.

Referring to FIGS. 11-A, 11-B, 11-C, and 11-D, the tray turntable (14*b*) along with the attached filled moveable tray (14*a*) slides towards a packaging loading station (15*a*) within the article packaging unit (15) at one end. The packaging loading station (15*a*) comprises a tray reception unit (15*b*) capable of receiving the moveable tray (14*a*) from the railing unit (14*c*). Additionally, the packaging loading station (15*a*) comprises a tray discharging unit (15*c*) responsible for discharging empty moveable trays (14*a*). Upon arrival at the packaging loading station (15*a*), the filled moveable tray (14*a*) can be discharged or dismounted from the tray turntable (14*b*) into the tray reception unit (15*b*).

The railing unit (14*c*), which carries the tray turntable (14*b*) without a moveable tray (14*a*), can, upon receiving a signal from the system control unit, switch its position from the first position (where it discharges the moveable tray to the tray reception unit) to the second position (where it receives empty moveable trays (14*a*) from the tray discharging unit (15*c*). This allows the empty moveable tray (14*a*) to move into the tray turntable (14*b*), preparing for the next set of gloves (3) or subsequent cycles.

The filled moveable tray (14*a*), now positioned at the tray reception unit (15*b*), awaits the next stage where it becomes the focal point for picking by at least one picking means (151) within the article packaging unit (15), ready for the subsequent packing process. Once the gloves (3) from the filled moveable tray (14*a*) are picked, the tray (14*a*) transforms into an empty state and smoothly moves back to its designated station, namely the tray discharging unit (15*c*), ready to receive the next set of gloves (3). This strategic rotation of moveable trays (14*a*) ensures a continuous flow of gloves (3), optimizing the efficiency of the entire automated process. The tray reception unit (15*b*) and tray discharging unit (15*c*) may operate in various ways, such as using a conveyor railing system where the moveable tray (14*a*) travels continuously from one end (tray reception unit (15*b*)) to another end (tray discharging unit (15*c*)), and the gloves (14*a*) are picked during the travelling journey: or utilizing first waiting area (tray reception unit (15*b*)) and second waiting area (tray discharging unit (15*c*)), where after gloves (3) are picked from the filled moveable tray (14*a*), the picking means (151) transfer the empty moveable tray (14*a*) from tray reception unit (15*b*) to tray discharging unit (15*c*), allowing for efficient glove handling during the process. This setup eliminates delays or waiting times, contributing to the overall efficiency of the system (1). In essence, a group of moveable trays (14*a*) takes turns in a choreography of receiving gloves from the intermediate trays (13*a*). This synchronized movement creates a continuous rotation, facilitating uninterrupted operation. This strategic rotation of moveable trays (14*a*) not only ensures a constant flow of gloves (3) but also optimizes the efficiency and continuity of the entire automated process.

Referring now to FIGS. 12-A, 12-B, 12-C, 12-D, 12-E, 12-F, the article packaging unit (15) of the system (1) besides comprising the packaging loading station (15*a*), further comprising several interconnected units for packaging process, whereby these units are connected to the system structure (5). The article packaging unit (15) further comprising at least a lifting means (15*d*) such as rotary lifter that is capable of rotating, configured to transfer items such as packaging boxes, gloves, etc, between the interconnected units of the article packaging unit (15).

The article packaging unit (15) comprising at least a packaging box loading station (15*e*) and at least a box erecting station (15*f*) connected adjacent to the packaging loading station (15*e*). The packaging box loading station (15*e*) is designated for loading prepared packaging boxes (B), which, upon loading, are released to the box erecting station (15*f*).

At the box erecting station, at least an unfolding and/or erecting mechanism is provided to facilitate the unfolding or assembling of a flat packaging box (B) into its three-dimensional shape. Alternatively, it opens up a flat packaging box (B) along its foldable traces to form a box-like configuration.

The article packaging unit (15) further comprising at least an overhead hoist transport (15*g*) positioned above the packaging box loading station (15*e*) and/or the box erecting station (15*f*) and/or the lifting means (15*d*), whereby it is designed or configured to perform various functions. Said functions include but not limited to, transferring empty packaging box (B) into the packaging box loading station (15*e*), or transferring empty packaging box (B) from the packaging box loading station (15*e*) to the box erecting station (15*f*), or transferring the erected box (B) from the box erecting station (15*f*) onto the lifting means.

Once the flat packaging box (B) is unfolded into an erected box (B) in the box erecting station (15*f*), the box (B) is transferred onto the lifting means (15*d*) by said overhead hoist transport (15*g*).

The article packaging unit (15) further comprising at least a tucking station (15*h*) comprising at least a tucking means (15*hh*), wherein it is connected adjacent to the packaging box loading station (15*e*) and the box erecting station (15*f*). Preferably, it is connected beneath the packaging box loading station (15*e*) and the box erecting station (15*f*). The lifting means (15*d*) upon the signal of the system control unit, transfers the erected box (B) to the tucking station (15*h*) for first tucking process. In this first tucking process, first side of the erected box (B) is enclosed, while leaving the second side open.

The article packaging unit (15) further comprising at least an article insertion module (15*i*) adjacent to the packaging loading station (15*a*), This article insertion module (15*i*) comprises at least a firming module (15*j*) which has a diameter smaller than the erected box (B), wherein it has a firming means capable of compacting or compressing the stacked gloves (3) so that the gloves (3) can be inserted into the erected box (B). Said firming module (15*j*) is connected to at least an inserting means (15*k*) which is responsible for initiating the firming module (15*j*) into the erected box (B).

The erected box (B) having the enclosed first side is transferred to the article insertion module (15*i*) by said lifting means (15*d*). The stacked gloves stationed at the tray reception unit (15*b*) are then picked by said picking means (151) and placed into the firming module (15*j*) for gloves compacting process. Subsequently, the inserting means (15*k*) is activated to insert the firming module (15*j*), along with the stacked gloves (3), into the erected box (B) through the open second side. Following the insertion, the inserting means (15*k*) retrieves the firming module (15*j*), leaving the stacked gloves (3) securely positioned inside the erected box (B).

The lifting means (15*d*) is then configured to transport the filled erected box (B), now containing the stacked gloves (3), back to the tucking station (15*h*) for a second tucking process. During this second tucking process, the tucking means (15*hh*) encloses the second side of the erected box (B), completing the packaging of the gloves (3). The packed gloves (3) are then ready to be transferred to subsequent stations or applications.

Figure 13:
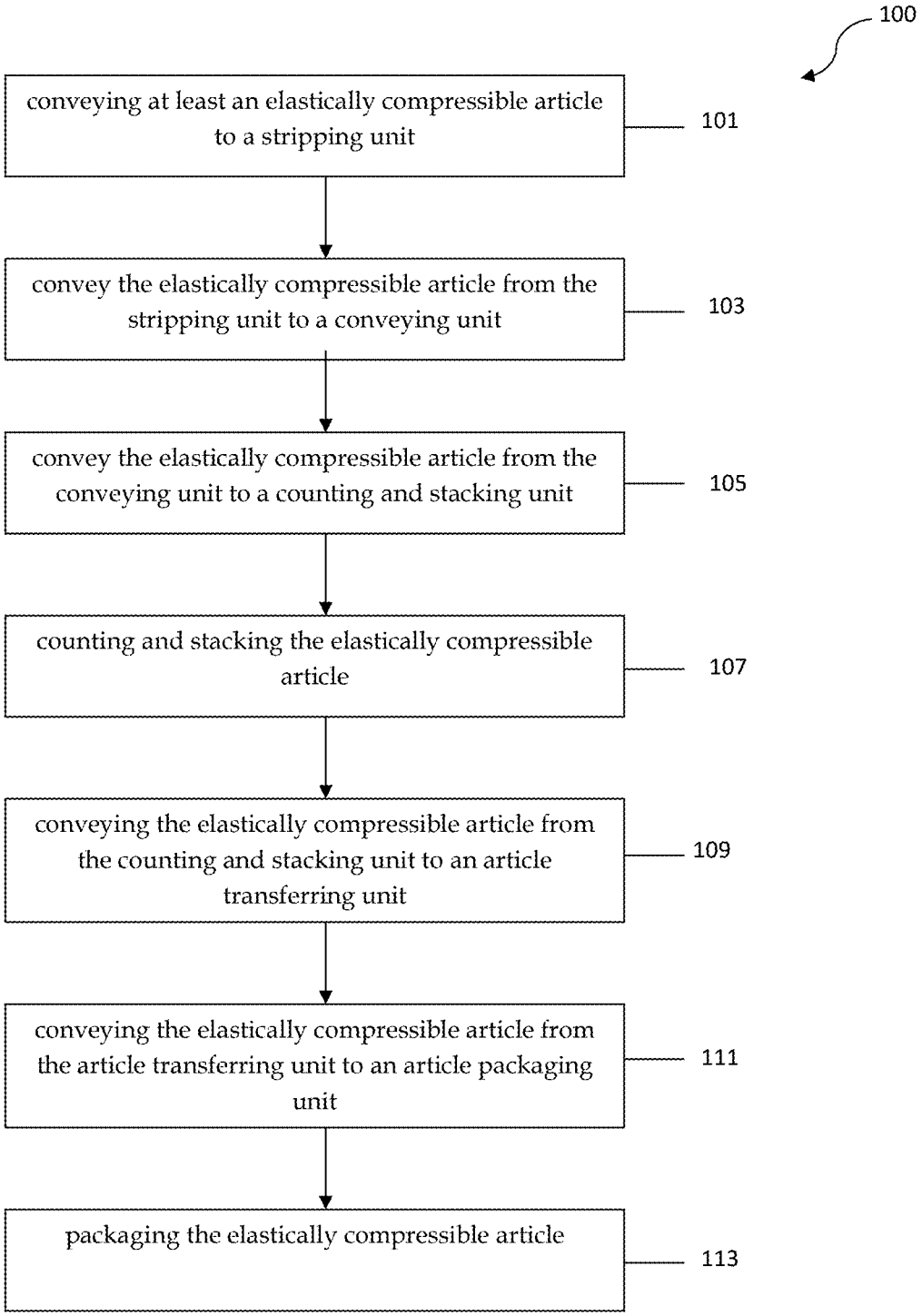
FIG. 13 illustrates an exemplary method flow for an automated handling of the elastically compressible articles according to another preferred embodiment of the present invention.

In another preferred embodiment of the present invention as depicted in FIG. 13, a method (100) for automated handling of at least one elastically compressible article such as pulling/stripping, stacking, counting is provided. Preferably, the method (100) integrates with the system (1) described above and involves a series of steps to ensure a streamlined and efficient process.

The method (100) for automated handling of at least one elastically compressible article (3) comprising the steps of: conveying at least an elastically compressible article to a stripping unit (101); conveying the elastically compressible article from the stripping unit to a conveying unit (103): conveying the elastically compressible article from the conveying unit to a counting and stacking unit (105); counting and stacking the elastically compressible article (107): conveying the elastically compressible article from the counting and stacking unit to an article transferring unit (109): conveying the elastically compressible article from the article transferring unit to an article packaging unit (111): characterized in that said method (100) further comprising the step of packaging the elastically compressible article (113) after the step of conveying the elastically compressible article from the article transferring unit to an article packaging unit (109), wherein the method (100) is carried out continuously in the sequence. The details of the steps (101, 103, 105, 107, 109) will be discussed in detail in the following paragraphs.

The method (100) commences with the step of conveying at least an elastically compressible article to a stripping unit (101). Initially, the elastically compressible article undergoes a precise stripping or pulling process, facilitated by semi-rollers, as expounded in the earlier system description. The engagement and subsequent disengagement of these semi-rollers internally rotate, effectively pulling off the article from the production line. Following this, the semi-rollers disengage, releasing the stripped article from the stripping unit to a conveying unit (103), where the stripped article, particularly gloves are lay on a conveyor belt of the conveying unit.

Continuing in the sequence, the method (100) proceeds to convey the elastically compressible article from the conveying unit to a designated counting and stacking unit (105). The conveying unit, encompassing first and second conveying means, involves the transfer of the article from the stripping unit to a first conveying means, followed by conveyance to the second conveying means, and ultimately, delivery to the counting and stacking unit facilitated by the second conveying means, which includes but not limited to at least a means of clipping, absorbing, pulling, grabbing, or picking, or the combination thereof.

Subsequently, the method (100) advances to the critical stage of counting and stacking the elastically compressible article within the counting and stacking unit (107). As the article enters the unit, specifically the temporary glove storage bin, it undergoes a counting and stacking process. The pressing means positioned above each bin comes into action, pressing each glove upon entry into the bin. This step entails a repetitive process, with the stripping and conveying steps being iterated to fill the bin with gloves while applying the pressing means.

Figure 14:
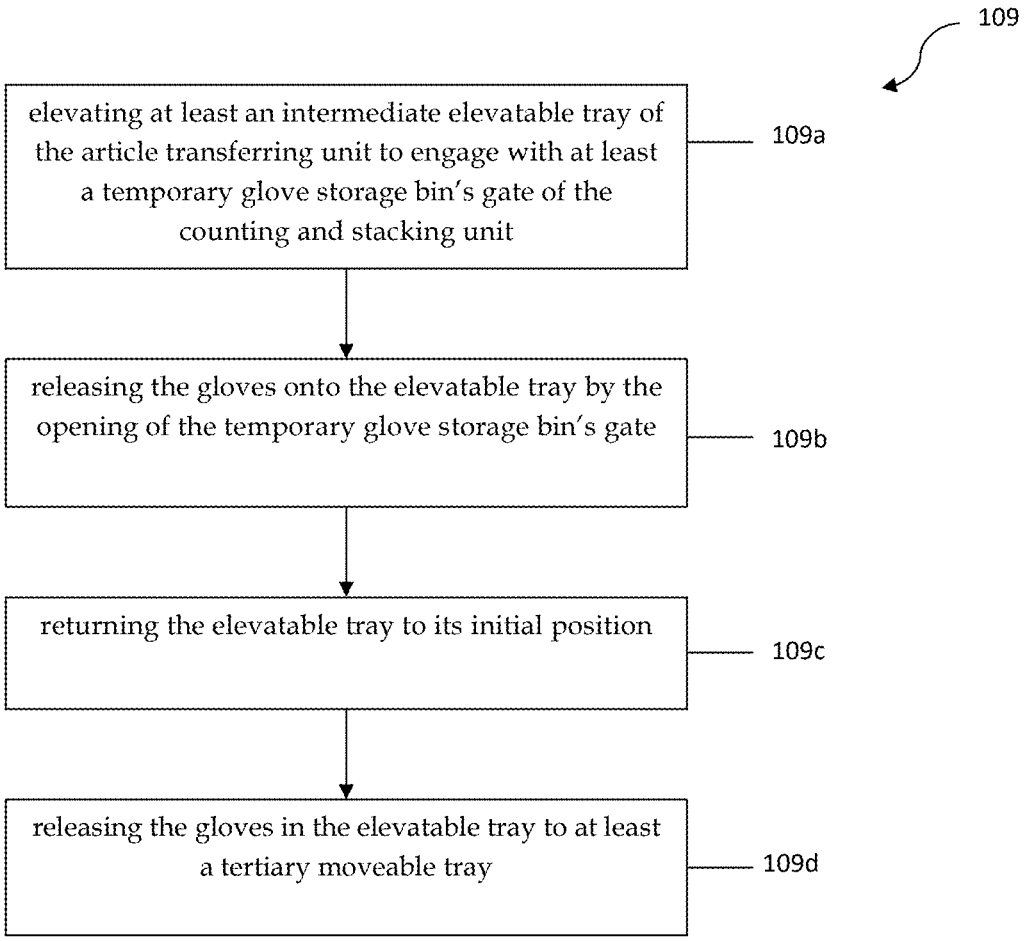
FIG. 14 illustrates sub-steps of the method flow for an automated handling of the elastically compressible articles according to another preferred embodiment of the present invention.

Upon reaching a predetermined quantity or reaching capacity, the method (100) transitions to conveying the elastically compressible article from the counting and stacking unit to an article transferring unit (109), as further illustrated in FIG. 14. This involves the elevation of at least an intermediate elevatable tray of the article transferring unit through an elevating means, engaging with at least a temporary glove storage bin's gate of the counting and stacking unit (109*a*), followed by releasing the gloves onto the elevatable tray by the opening of the temporary glove storage bin's gate. (109*b*). The bin gate of the temporary glove storage bin opens, enabling the stacked gloves to rest and settle on the elevatable tray, wherein the opening of the bin's gate is not obstructed by the engagement of the elevatable tray through at least an anti-obstruction means, allowing the gloves to be rested onto the elevatable tray.

Subsequently, the bin gate closes, and the elevatable tray returns to its initial position for subsequent transfers (109*c*).

The method (100) further involves a tertiary moveable tray, stationed to receive the stacked gloves from the intermediate tray (109*d*). The intermediate tray's gate opens, releasing the stacked gloves into the tertiary moveable tray slidably mounted on a tray turntable, which then slides within a railing unit to transfer the stacked gloves to an article packaging unit. The tertiary moveable tray may incorporate rotation to optimize the position or orientation of the gloves, ensuring a smooth packaging process. Preferably, said tertiary moveable tray is slidably mounted on a tray turntable capable or rotating and sliding within a railing unit, whereby said railing unit is capable of switching between a first and second position through at least a moving mechanism. This comprehensive method (100) underscores the integration and efficiency achieved through the inventive system for automated article handling.

Figure 15:
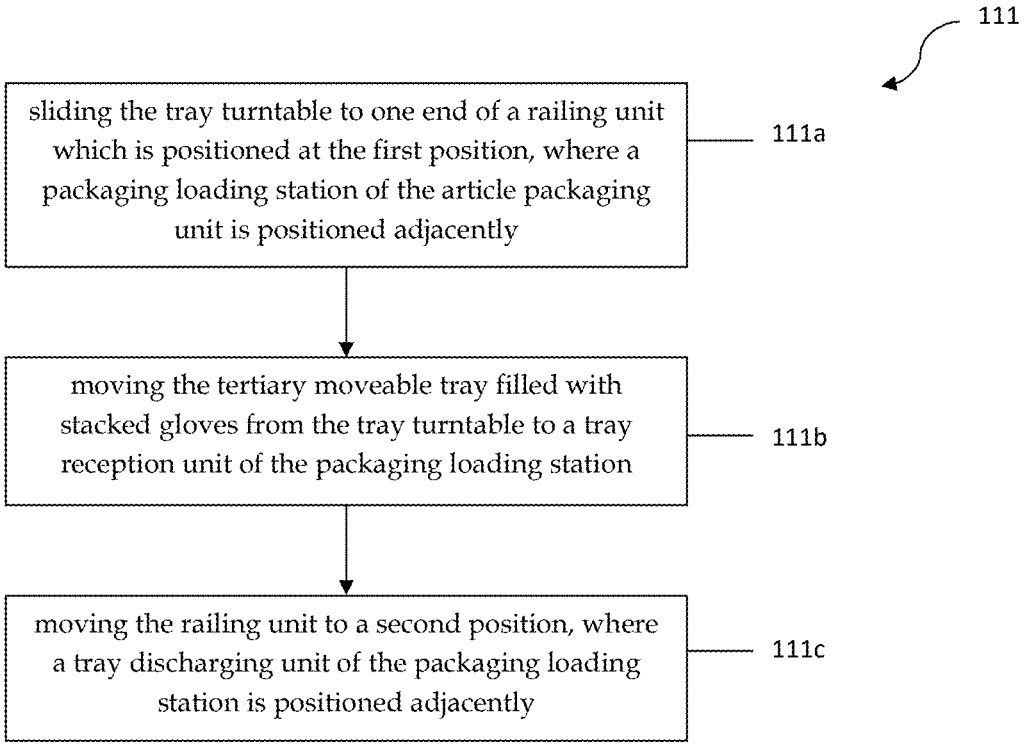
FIG. 15 illustrates another set of sub-steps of the method flow for an automated handling of the elastically compressible articles according to another preferred embodiment of the present invention.

The method (100) then progresses to the step of conveying the elastically compressible article from the article transferring unit to an article packaging unit (111), as shown in FIG. 15. Firstly, the tray turntable slides to one end of a railing unit which is positioned at the first position, where a packaging loading station of the article packaging unit is positioned adjacently (111*a*). The packaging loading station comprising at least a tray reception unit position adjacent to the first position of the railing unit, and at least a tray discharging unit positioned at a second position of the railing unit. The tertiary moveable tray filled with stacked gloves is moved or slide from the tray turntable to the tray reception unit of the packaging loading station (111*b*). Then, the railing unit moves from the first position to the second position, where a tray discharging unit of the packaging loading station is positioned adjacently. (111*b*). Subsequently, at least an empty tertiary moveable tray is discharged from the tray discharging unit into the tray turntable (111*c*).

Following this, the method (100) progresses to the pivotal step of packaging the elastically compressible article (113). The elastically compressible article or the stacked gloves, having been efficiently transferred from the article transferring unit, undergo a packaging sequence to ensure precision and orderliness.

Initially, the gloves in the tertiary moveable tray of the tray reception unit are methodically picked by at least one picking means and delicately placed into a firming module. This module acts to compress and compact the gloves for the subsequent packaging steps. Simultaneously, the packaging box, either pre-loaded or loaded in real-time, undergoes a transformative process facilitated by an erecting means. This process entails unfolding or assembling the flat packaging box into a three-dimensional configuration, forming the characteristic box shape suitable for glove containment With the first side of the packaging box exposed, a tucking means is engaged to enclose this side securely. The gloves nestled in the firming module, are then precisely and gently inserted into the packaging box by at least an associated inserting means, entering from the second side. The tucking means comes into play once more, ensuring that the gloves are snugly tucked within the packaging box, leaving no residue or trace outside the box. Following this, the second side of the packaging box is sealed by the tucking means, effectively completing the packaging process.

This systematic method (100) ensures that the elastically compressible articles, in this case, gloves, are not only accurately stripped, counted, stacked, pressed and transferred but are also efficiently and securely packaged for subsequent use. The integration of various mechanisms, including stripping means, conveying means, elevating means, picking means, glove carriers, erecting means, and tucking means, exemplifies the sophistication and efficacy of the automated handling system. Notably, this system operates as a unified entity, eliminating the need for separate components and eradicating waiting times and manual labor associated with the packaging process. The entire process unfolds continuously, devoid of delays, waiting periods, or the need for manual transfers.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto. The scope of the invention encompasses numerous alternatives, modifications and the equivalents. Of necessity, there are many alternative ways of configuring and implementing the invention to suit particular installations and environments while providing biological outcomes of differing design.

What is claimed is:

1. A system for automated handling of at least one elastically compressible article, comprising:

at least an article conveying unit for conveying said article;

at least an article counting and stacking unit for counting and stacking a plurality of elastically compressible articles received from the article conveying unit, the article counting and stacking unit comprising a temporary article storage bin and a pressing element configured to compact the elastically compressible articles within the bin, wherein said article counting and stacking unit is connected adjacent to the article conveying unit;

at least an article transferring unit for transferring stacked elastically compressible articles received from the article counting and stacking unit, wherein said article transferring unit is connected adjacent to the article counting and stacking unit; and at least an article packaging unit for packaging the article received from the article transferring unit, wherein said article packaging unit is connected adjacent to the article transferring unit;

wherein the article conveying unit comprises a first conveying element comprising at least one conveyor belt and at least a second conveying element configured to grip or clip the elastically compressible article for transfer to the article counting and stacking unit, and wherein the article conveying unit, the article counting and stacking unit, the article transferring unit, and the article packaging unit are accommodated as a unified system.

2. The system for automated handling of at least one elastically compressible article as claimed in claim 1, the article transferring unit comprising at least a drop-prevention mechanism or at least an anti-gravitational means for transferring the stacked elastically compressible articles.

3. The system of claim 2, wherein the temporary article storage bin includes a gate with spaced-apart members and said drop-prevention mechanism or anti-gravitational means is an intermediate elevatable tray that includes tray leaves with spaced-apart members.

4. The system for automated handling of at least one elastically compressible article as claimed in claim 2, wherein said drop-prevention mechanism or anti-gravitational means is an intermediate elevatable tray arranged below or connected beneath the article counting and stacking unit, wherein said tray is controlled by at least an elevating means for elevation movement between an initial position and a position below the article counting and stacking unit.

5. The system for automated handling of at least one elastically compressible article as claimed in claim 4, wherein said temporary article storage bin comprises a bin gate capable of opening and closing;

said system further comprising at least an anti-obstruction engaging means comprising, at least a gate leaf at the bin gate comprises first spaced-apart members; and at least a tray leaf at the intermediate elevatable tray comprises second spaced-apart members, whereby each second spaced-apart member is elevatable in a direction towards the spacing between each first spaced-apart member during engagement.

6. The system for automated handling of at least one elastically compressible article as claimed in claim 5, wherein said article transferring unit further comprising at least a tertiary moveable tray for receiving the stacked articles from the temporary article storage bin, wherein the tertiary moveable tray is connected beneath the intermediate tray, wherein it is slidably mounted on a tray turntable capable of rotation to adjust the positioning of the articles, the tray turntable slides and/or rotates within a railing unit.

7. The system for automated handling of at least one elastically compressible article as claimed in claim 6, wherein said railing unit is capable of switching its position between a first and a second position, facilitated by a moving mechanism.

8. The system for automated handling of at least one elastically compressible article as claimed in claim 7, the article packaging unit comprising at least a packaging loading station comprises at least a tray reception unit for receiving the tertiary moveable tray filled with stacked articles at a first position and at least a tray discharging unit for releasing an empty moveable tray to the tray turntable at a second position.

9. The system for automated handling of at least one elastically compressible article as claimed in claim 1, said article packaging unit comprising:

at least a packaging loading station for receiving the stacked articles from the article transferring unit;

at least a packaging box loading station for loading of at least a packaging box;

at least a box erecting station connected adjacent to the packaging loading station for assembling the packaging box into its three-dimensional shape;

at least a tucking station connected adjacent to the packaging box loading station and/or the box erecting station for enclosing the sides of the packaging box;

at least an article insertion module connected adjacent to the packaging loading station for inserting the stacked articles into the packaging box;

at least an overhead hoist transport positioned proximally to the packaging box loading station and/or the box erecting station; and at least a lifting means capable of rotating/elevating, configured to transport the packaging box between the box erecting station, the tucking station and the article insertion module.

10. The system of claim 1, wherein the article packaging unit is configured to insert stacked elastically compressible articles into a packaging box in a horizontally oriented stack.

11. The system of claim 1, wherein the article packaging unit comprises a firming module configured to compact the stacked elastically compressible articles before insertion into a packaging box.

12. A system for automated handling of at least one elastically compressible article, comprising:

at least an article stripping unit for stripping off the article from a production line;

at least an article conveying unit for conveying said article from said article stripping unit, wherein said article conveying unit is connected adjacent to the article stripping unit;

at least an article counting and stacking unit for counting and stacking a plurality of elastically compressible articles received from the article conveying unit, wherein said article counting and stacking unit is connected adjacent to the article conveying unit, and comprises a temporary article storage bin and a pressing element configured to compact the elastically compressible articles within the bin;

at least an article transferring unit for transferring stacked elastically compressible articles received from the article counting and stacking unit, wherein said article transferring unit is connected adjacent to the article counting and stacking unit; and at least an article packaging unit for packaging the stacked elastically compressible articles received from the article transferring unit, wherein said article packaging unit is connected adjacent to the article transferring unit;

wherein the article conveying unit comprises a first conveying element comprising at least one conveyor belt and at least a second conveying element configured to grip or clip the elastically compressible article for transfer to the article counting and stacking unit, and wherein the article stripping unit, the article conveying unit, the article counting and stacking unit, the article transferring unit, and the article packaging unit are accommodated as a unified system.

13. A system for automated handling of at least one elastically compressible article, comprising:

at least an article stripping unit for stripping off the article from production line;

at least an article conveying unit for conveying said article from said article stripping unit, wherein said article conveying unit is connected adjacent to the article stripping unit;

at least an article counting and stacking unit for counting and stacking a plurality of elastically compressible articles received from the article conveying unit, wherein said article counting and stacking unit is connected adjacent to the article conveying unit; and at least an article transferring unit for transferring stacked elastically compressible articles received from the article counting and stacking unit to a subsequent station or unit, wherein said article transferring unit is connected adjacent to the article counting and stacking unit;

wherein the article transferring unit comprises an intermediate elevatable tray configured to receive the stacked elastically compressible articles from the article counting and stacking unit and to descend in a controlled manner to transfer the stacked elastically compressible articles, thereby functioning as a drop-prevention mechanism or an anti-gravitational means.

14. The system for automated handling of at least one elastically compressible article as claimed in claim 13, wherein the intermediate elevatable tray is arranged below or connected beneath the article counting and stacking unit, wherein said tray is controlled by at least an elevating means for elevation movement between an initial position and a position below the article counting and stacking unit.

15. The system of claim 13, wherein the article counting and stacking unit comprises a temporary article storage bin that includes a gate with spaced-apart members and the intermediate elevatable tray includes tray leaves with spaced-apart members, the members being configured to interleave to prevent obstruction when transferring stacked elastically compressible articles.

16. A method for automated handling of at least one elastically compressible article comprising:

i. conveying at least an elastically compressible article to a stripping unit;

ii. conveying the elastically compressible article from the stripping unit to a conveying unit;

iii. conveying the elastically compressible article from the conveying unit to a counting and stacking unit;

iv. counting and stacking a plurality of elastically compressible articles;

v. conveying the stacked elastically compressible articles from the counting and stacking unit to an article transferring unit, wherein the article transferring unit comprises an intermediate elevatable tray that descends in a controlled manner to receive and transfer the stacked elastically compressible articles as a drop-prevention mechanism or anti-gravitational means;

vi. conveying the stacked elastically compressible articles from the article transferring unit to an article packaging unit;

wherein said method further comprising packaging the stacked elastically compressible articles after conveying the stacked elastically compressible articles from the article transferring unit to an article packaging unit, wherein the method is carried out continuously in a sequence of i to vi.

17. The method for automated handling of at least one elastically compressible article as claimed in claim 16 wherein said anti-gravitational means or drop-prevention means is carried out with the following:

(a) elevating at least an intermediate elevatable tray of the article transferring unit to engage with at least a temporary article storage bin's gate of the article counting and stacking unit; and (b) releasing the stacked articles onto the elevatable tray by the opening of the temporary article storage bin's gate;

wherein the opening of the bin's gate is not obstructed by the engagement of the elevatable tray through at least an anti-obstruction means, allowing the stacked articles to be rested onto the elevatable tray.

18. The method for automated handling of at least one elastically compressible article as claimed in claim 17, wherein said anti-obstruction means comprising at least a gate leaf at the bin gate comprises first spaced-apart members; and at least a tray leaf at the intermediate elevatable tray comprises second spaced-apart members, whereby each second spaced-apart member is elevatable in a direction towards the spacing between each first spaced-apart member during engagement.

19. The method for automated handling of at least one elastically compressible article as claimed in claim 17, wherein conveying the stacked elastically compressible article from the counting and stacking unit to an article transferring unit further comprises the following after releasing the stacked articles onto the elevatable tray by the opening of the temporary glove article storage bin's gate:

c. returning the elevatable tray to its initial position; and d. releasing the stacked articles in the elevatable tray to at least a tertiary moveable tray;

wherein said tertiary moveable tray is slidably mounted on a tray turntable capable or rotating and sliding within a railing unit, whereby said railing unit is capable of switching between a first and a second position through at least a moving mechanism.

20. The method for automated handling of at least one elastically compressible article as claimed in claim 19, wherein conveying the elastically compressible article from the article transferring unit to an article packaging unit comprises the following:

i. sliding the tray turntable to one end of a railing unit which is positioned at a first position, where a packaging loading station of the article packaging unit is positioned adjacently;

ii. moving the tertiary moveable tray filled with stacked articles from the tray turntable to a tray reception unit of the packaging loading station;

iii. moving the railing unit to a second position, where a tray discharging unit of the packaging loading station is positioned adjacently; and iv. discharging an empty tertiary moveable tray from the tray discharging unit into the tray turntable.

21. The method of claim 16, wherein the intermediate elevatable tray descends at a controlled speed under the control of an elevating means.

22. A method for automated handling of at least one elastically compressible article comprising:

i. conveying at least an elastically compressible article to a stripping unit;

ii. conveying the elastically compressible article from a stripping unit to a conveying unit;

iii. conveying the elastically compressible article from the conveying unit to a counting and stacking unit;

iv. counting and stacking a plurality of elastically compressible articles;

v. conveying the stacked elastically compressible articles from the counting and stacking unit to an article transferring unit;

wherein conveying the stacked elastically compressible articles from the counting and stacking unit to an article transferring unit comprising the following:

a. elevating at least an intermediate elevatable tray of the article transferring unit to engage with at least a temporary article storage bin's gate of the counting and stacking unit; and b. releasing the articles onto the elevatable tray by the opening of the temporary article storage bin's gate;

wherein the opening of the bin's gate is not obstructed by the engagement of the elevatable tray through at least an anti-obstruction means, allowing the stacked articles to be rested onto the elevatable tray.

* * * * *